US006520071B1

(12) United States Patent
Lanza

(10) Patent No.: US 6,520,071 B1
(45) Date of Patent: Feb. 18, 2003

(54) HAND-HELD SUCTION PUMP

(75) Inventor: Fabrizio Lanza, Cernusco sul Naviglio (IT)

(73) Assignee: Aracaria B. ., Amsterdam (NL)

( * ) Notice: Subject to any disclaimer, the term of this patent is extended or adjusted under 35 U.S.C. 154(b) by 0 days.

(21) Appl. No.: 09/979,435

(22) PCT Filed: May 18, 2000

(86) PCT No.: PCT/EP00/04518

§ 371 (c)(1),
(2), (4) Date: Feb. 21, 2002

(87) PCT Pub. No.: WO00/71422

PCT Pub. Date: Nov. 30, 2000

(30) Foreign Application Priority Data

May 21, 1999 (EP) ..... 99110049

(51) Int. Cl.[7] ..... A23L 1/00; B65B 31/04; B65B 31/06

(52) U.S. Cl. ..... 99/472; 99/646 C; 141/65; 141/96; 141/198; 215/260; 215/262

(58) Field of Search ..... 99/472, 476, 467, 99/646 C; 141/198, 65, 96; 206/524.8; 215/260, 262; 220/231; 417/313, 411; 53/375.9, 390, 512, 133.4, 139.2, 373.2

(56) References Cited

U.S. PATENT DOCUMENTS 303,014 A * 8/1884 Hoyt ..... 99/472
1,572,190 A * 2/1926 Don ..... 53/510
1,621,132 A * 3/1927 Reinbold ..... 99/472
2,049,872 A * 8/1936 Sera ..... 141/65
2,669,176 A * 2/1954 Lazerus ..... 417/313 X
4,051,971 A * 10/1977 Saleri ..... 215/260
4,287,819 A * 9/1981 Emerit ..... 99/472
5,195,427 A * 3/1993 Germano ..... 99/472
5,215,445 A * 6/1993 Chen ..... 417/313
5,287,680 A * 2/1994 Lau ..... 53/512
5,765,608 A * 6/1998 Kristen ..... 141/198

* cited by examiner

*Primary Examiner*—Timothy F. Simone
(74) *Attorney, Agent, or Firm*—K. David Crockett, Esq.; Crockett & Crockett

(57) ABSTRACT

A hand-held suction pump for creating a vacuum in a container (2) provided with a suction valve (3), comprising an elongated outer casing in which an electric motor (7) and a piston pump (14, 15) driven by the motor (7) are accommodated, wherein the pump chamber (14) of the piston pump is connected by an inlet valve and a suction duct (28) to a hollow tip (34) at the free end of the casing for direct coupling with the suction valve of the container, the pump chamber being further connected by an outlet valve to an exhaust duct (29) having a duct opening on the outer surface of the wall of the outer casing for porting an exhaust flow to the exterior of the outer casing. In order to reduce noise caused by the exhaust flow, the duct opening of the exhaust duct (29) is overlapped by a baffle (38) which is separated by a gapped distance from the outer surface of the wall of the outer casing so as to deflect the exhaust flow exiting the duct opening by a substantial angle.

12 Claims, 4 Drawing Sheets

HAND-HELD SUCTION PUMP

FIELD OF THE INVENTIONS

The inventions described below relate the field of hand-held suction pumps intended for use in evacuating containers.

BACKGROUND OF THE INVENTIONS

The invention refers to a hand-held suction pump for creating a vacuum in a container provided with a suction valve, comprising an elongated outer casing in which an electric motor and a piston pump driven by the motor are accommodated, wherein the pump chamber of the piston pump is connected by an inlet valve and a suction duct to a hollow tip at the free end of the casing for direct coupling with the suction valve of the container, the pump chamber being further connected by an outlet valve to an exhaust duct having a duct opening on the outer surface of the wall of the outer casing for porting an exhaust flow to the exterior of the outer casing.

A hand-held suction pump of the aforementioned kind is disclosed in EP 0 510 360 A. It is useful especially in the household field for creating a high vacuum in household containers containing food, either solid, semi-solid or liquid to be preserved in the absence of air or air access, particularly in the absence of oxygen.

The known hand-held suction device has been proven to satisfy the aforementioned need but may be subject to further improvement regarding some noise generated by the intermittent air flow which must necessarily exit the device during operation.

SUMMARY

According to the invention, a hand-held suction pump of the present type is provided and constructed primarily so as to effect a reduction of the noise generated in exhausting the air as it is sucked out during evacuation of the container.

This aim is attained by the invention in that the duct opening of the exhaust duct on the outer surface of the wall of the outer casing of the hand-held suction pump is overlapped by a baffle which is separated by a gapped distance from the outer surface of the wall of the outer casing so as to deflect the exhaust flow exiting the duct opening by a substantial angle before the exhaust flow is discharged to the surrounding air.

By deflecting the exhaust flow exiting the duct opening of the exhaust duct by a substantial angle, it is possible to reach a substantial reduction of the noise generated by the air streams which intermittently exit the device during operation. The magnitude of the deflecting angle mainly depends on the shape and direction of the exhaust duct with respect to the contour of the outer surface of the casing at the opening site of the duct as well as on the construction and shape of the opening of the duct. In most cases, the deflecting angle is 60° to 120°. If the exhaust duct extends mainly in a radial direction with respect to the axis of the outer casing of the suction pump and if the outer surface of the casing at the opening site extends in parallel with said axis, the amount of the deflecting angle will be substantially 90°.

Further, the deflecting direction may be varied to a great extent according to the construction of the contours of the exhaust duct and the outer surface of the casing. Thus, it is possible to deflect the exhaust flow at the baffle into the axial direction of the outer casing of the suction pump toward the top portion of the casing. In other cases, the deflection direction may be lateral. Further, it is possible to construct outlet gaps or openings at both lateral or axial sides of the baffle to simultaneously split apart the exhaust flow exiting the duct opening of the exhaust duct. At present, it is preferred that an exit port is formed between the baffle and the wall of the outer casing designed for directing the exhaust flow in a direction substantially parallel to the contour of the outer casing surface toward the hollow tip at the free end of the casing. In this way, the existing exhaust flow will be directed away from the user holding the suction pump in one hand during operation of the device.

Moreover, the construction of the baffle and of its connection to the outer casing may be freely chosen as desired according to the casing construction. At present, it is preferred to form the baffle by a wall portion of a sleeve attached to the outer casing. Such a construction of the baffle is particularly of advantage if the suction pump comprises an interchangeable terminal cap supporting the hollow tip at the free end of the casing, the terminal cap being attached by a removable sleeve which also serve to form the baffle of the invention.

BRIEF DESCRIPTION OF THE DRAWINGS

The invention is further described by way of preferred embodiments as disclosed in the drawings.

DETAILED DESCRIPTION OF THE INVENTIONS

Figure 1:
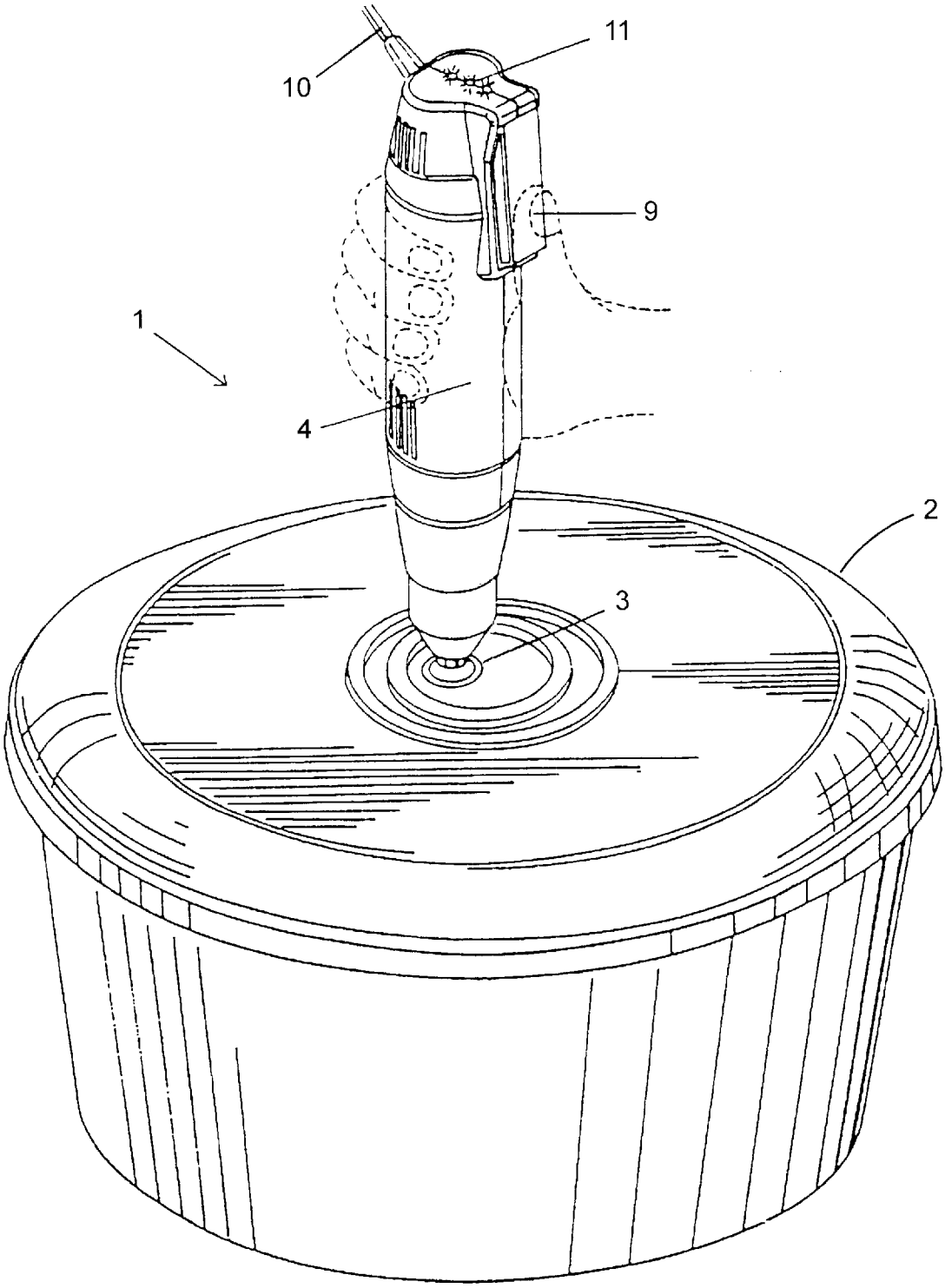
FIG. 1 is an axonometric view showing the hand-held suction pump according to the invention being used to establish a vacuum in a container provided with a suction valve.
Figure 2:
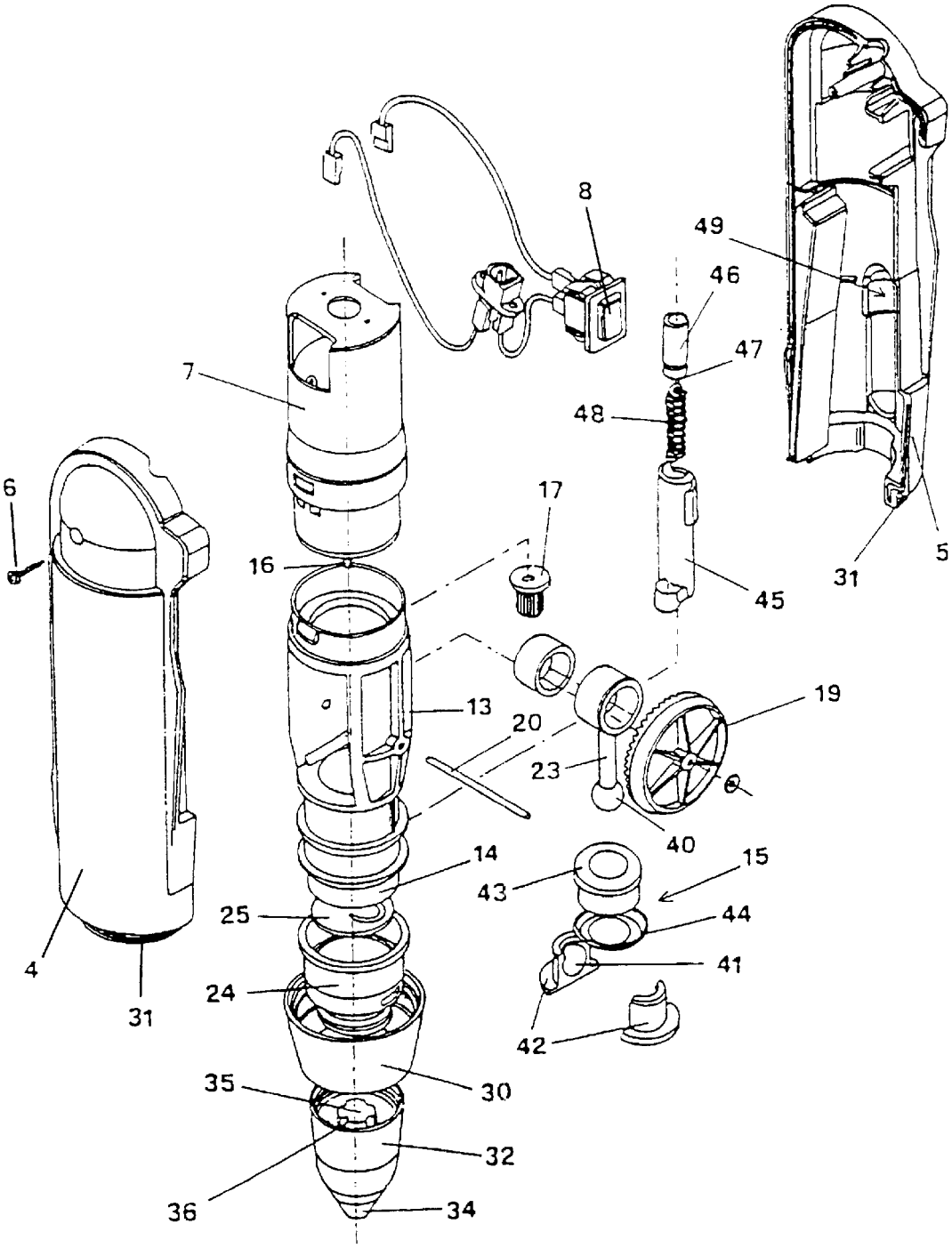
FIG. 2 is an exploded axonometric view of a preferred embodiment of the suction pump shown in FIG. 1.
Figure 4:
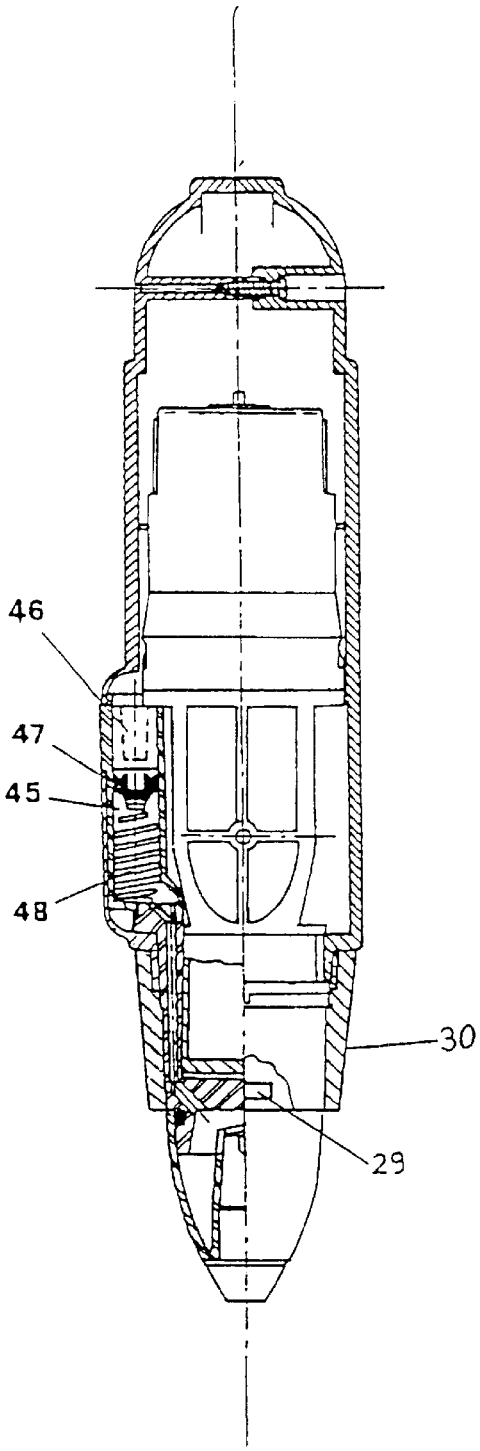
FIG. 4 is a different section of the suction pump.
Figure 3:
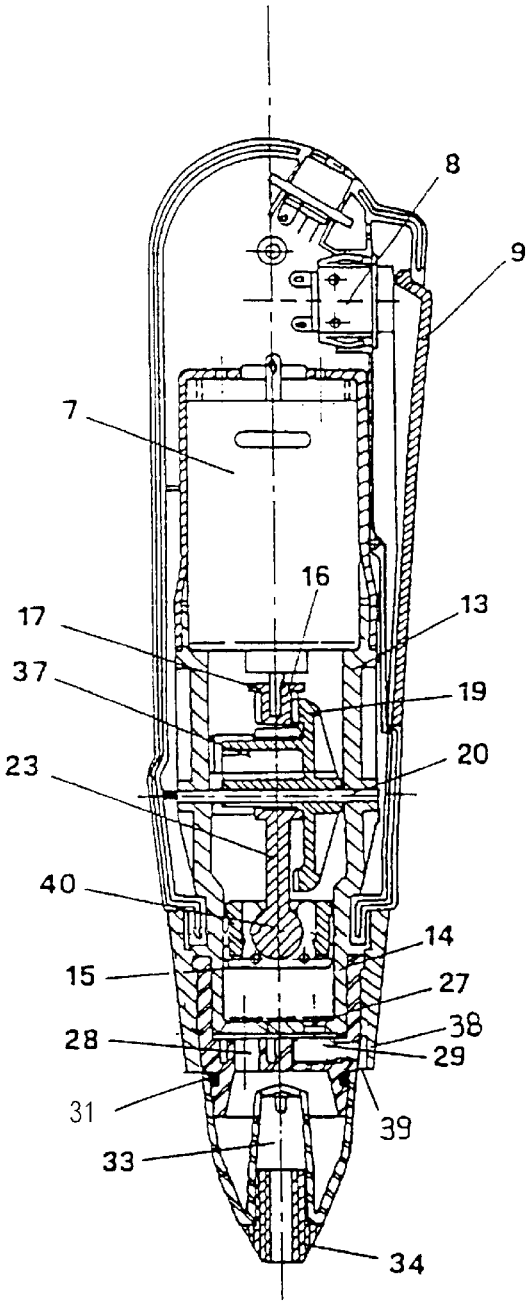
FIG. 3 is a mid-section of the suction pump according to the invention.

With reference to FIGS. 1 to 3, the suction pump according to the invention has been indicated as a whole with reference number 1. FIG. 1 shows this suction pump 1 being applied to suction valve 3 of a container 2, in which a vacuum is to be established.

As is more easily visible in the exploded view of FIG. 2, the hand-held suction pump 1 comprises an elongated outer casing partly formed by two substantially identical halves 4 and 5, assembled with screws 6. In the upper part of the outer casing, an electric motor 7 is disposed to be operated by a press switch 8 actuated by a pivoted key 9. In these figures part of a power cable 10 is shown which is present for case that the motor 7 is driven by line current. It is evident, however, that the suction pump could also be driven by a battery, which is possibly rechargeable by line current. The figures also depict three LEDs 11 of different colours, the status of which is determined by the load of the motor 7 and which serve to signal the degree of vacuum reached in the container during pump operation.

A support cage 13 is provided below motor 7 in order to hold the cylinder 14 of the pump and the speed reduction group (to be described later) and which transmits the reciprocating motion to the piston 15.

A pinion 17 is force-fit on the outward end of the shaft 16 of the motor 7, and this pinion 17 may integrated with an impeller 18 to cool the motor. The pinion 17 is engaged with a crown gear 19 rotatably mounted on a shaft 20 held by the cage 13. An eccentric hollow 37 is provided inside the crown gear 19 and serves to support a connecting rod 23, the free end of which supports the piston 15.

In particular, said free end has the shape of a sphere 40 located in semispheric seating 41 of two symmetrical pads 42, opposed to the piston. The pads 42 are fixed to a bush 413, which is inserted onto these pads upon interposition of a gasket 44.

In the embodiment illustrated in FIGS. 1 to 3, shaft. 20, which serves as the axis of the crown gear 19, is perpendicular to the motor shaft 16, and the piston-cylinder unit of the suction pump is perfectly aligned with the axis of the motor 7. Hence, the suction pump is substantially straight-lined. However, it is evident that the axis of the cylinder 4 can be inclined up to 90° with respect to the motor shaft 16 in a plane perpendicular to the plane of the page in FIG. 3 while maintaining shaft 20 in a fixed position.

Below cylinder 14 there is a valve body 24, which is separated from cylinder 14 by an interposed diaphragm valve 25 effective as an inlet valve and an outlet valve, respectively. At the bottom of cylinder 14 there are two openings 26 and 27, which are respectively connected through the diaphragm valve 25 to a suction duct 28 and to a radially extending exhaust duct 29 of the valve body 24.

As shown in FIG. 3, the valve body 24, the diaphragm valve 25 and the cylinder 14 (the latter might also be integral with cage 13) are assembled by means of a threaded sleeve 30, which is threaded on a thread 31 formed at the lower external ends of the two device casing halves 4 and 5. The outside duct opening of the exhaust duct 29 is overlapped by a baffle 38 which is separated by a gapped distance from the outer surface of the wall of the outer casing so as to deflect the exhaust flow exiting the duct opening by an substantial angle before the exhaust flow is discharged to the surrounding air. In the present embodiments shown in the drawings, the baffle 38 is formed by a wall portion of the lower free end wall of the sleeve 30. To this end, the sleeve is recessed at its inner wall along the area where the sleeve is overlapping the duct opening thereby bringing about the gapped distance between the baffle 38 and the outer casing wall and leaving an exit port 39 between the baffle and the outer casing wall for directing the exhaust flow in a direction substantially parallel to the axis of the outer casing toward the hollow tip 34 at the free end of the casing.

In another embodiment, not shown in the drawings, the outlet duct opening of the exhaust duct 29 may upwardly be displaced by a certain distance thereby enabling the sleeve 30 to be made shorter.

A terminal cap 32 is fixed to the body valve 24, e.g. by means of a bayonet or a threaded joint, with a locking ring 31 interposed therebetween. This terminal cap, preferably made of a transparent material, has an internal seat 33 for the press fit of a tip 34 made of a flexible material such as rubber. It is this tip which will engage the seating of suction valve 3 provided on the container 2. In the embodiment shown in the attached figures, the tip 34 and the corresponding seating of suction valve 3 have the shape of complementary truncated cones.

The seat 33 of the terminal cap 32 has a solid end 35, as shown in the exploded view of FIG. 2, and side openings 36, through which the air sucked from container 2 is forced during pump operation. In this way, any possible condensate is collected in the terminal cap 32 and is subsequently drained by removing the cap from the pump. The transparency of the cap 32 allows a visual check for accumulation of condensate in the cap.

As an alternative or in addition to the LEDs 11 signaling the degree of vacuum established, a mechanical indicator may be provided comprising a cylinder 45 whose lower end is connected to the suction tip 34 and therefore to the container 2 in which a vacuum is to be established and in which this connection is through a duct (not shown) in the sidewall of the body valve 24. A piston 46 is situated with its gasket 47 within the cylinder 45 and is subjected to an upward force applied by spring 48.

The vacuum obtained in container 2 during the operation of the suction pump tends to suck the piston 46 downwardly against the force of the spring 48. The position of this spring 48 is visible through the transparent cylinder 45 as well as through an opening 49 arranged in one of the two halves 4 and 5, and hence serves as an indication of the degree of vacuum created.

The operation of the hand-held suction pump according to the invention is as follows.

The suction pump is held with one hand, as schematically indicated in FIG. 1 (or the opposite hand can be used to actuate the switch with the forefinger) and is positioned directly on a container 2 in which a vacuum is to be established by inserting the tip 34 in the seating of the corresponding valve 3 of the container. The motor 7 is actuated by pushing the pivot key 9, thus rotating the conical pinion 17. This pinion 17 transmits the rotation to the crown gear 19 which, through-the eccentric hollow 37, moves the connecting rod 23—piston group by reciprocative motion. During the upward movement of the piston corresponding to the suction phase, the air sucked from the container passes through the openings 36, leaves the condensate and solid particles, if any, in the terminal cap 32 and enters the chamber of the cylinder passing through the duct 28 of the valve body 24, through the diaphragm valve 25 and through the opening 26 of the cylinder bottom. In this phase, the opening 27 in the cylinder bottom is obviously closed by the diaphragm valve 25. During the downward movement of the piston, the diaphragm valve 25 closes the opening 26 and opens the opening 27 of the cylinder bottom 14, thus exhausting the air present in the cylinder through the duct 29 provided in the valve body 24. Since the exhaust flow is deflected by baffle 38 by angle of almost 90°, the noise generated by the exhaust flow will be on a low level. For further noise reduction, a standard sponge filter (not shown) may be press-fitted into the exhaust duct 29.

As the vacuum increases in container 2, the load of the motor 7 increases. This increase is sensed by suitable electronic circuitry and is signaled to the user by the selective lighting of the LEDs 11 indicating the degree of vacuum reached in the container.

In the cases of a mechanical indicator, the degree of vacuum reached is signaled by the position of the piston 46, which moves as the vacuum in the container increases.

The transmission system between motor and suction pump according to the invention is particularly advantageous when the above elements are perfectly aligned, but can be conveniently used up to an inclination of 45° of these elements.

Even though in FIG. 1 a rigid container is shown, it is evident that the suction pump according to the invention could be used with any other type of container, for instance with flexible ones, provided that they have a valve suitable to seat the tip 34, which has a convenient square section but, being interchangeable, could be substituted with a tip having a different cross section, for example a pyramidal one.

Figure 5:
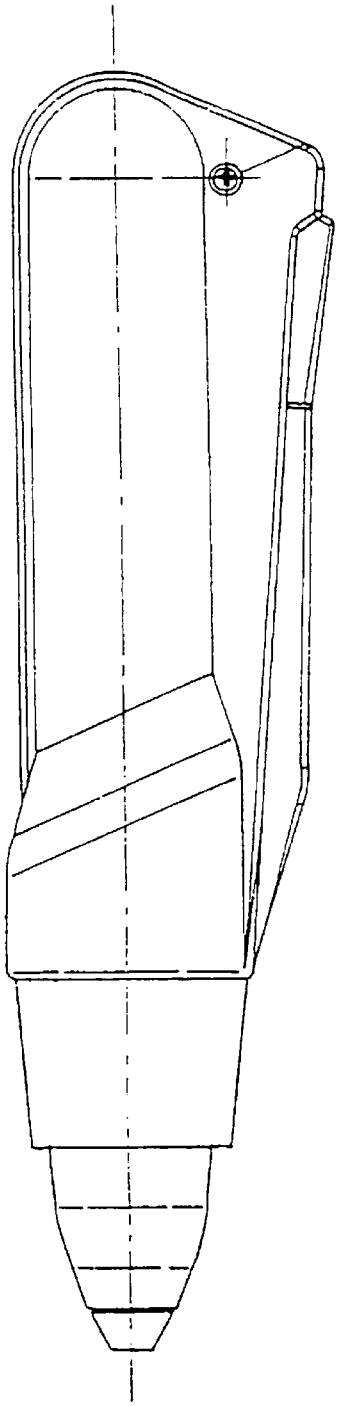
FIG. 5 is a side-view of a possible modified embodiment of the shape of the suction pump shown in the previous figures.
Figure 6:
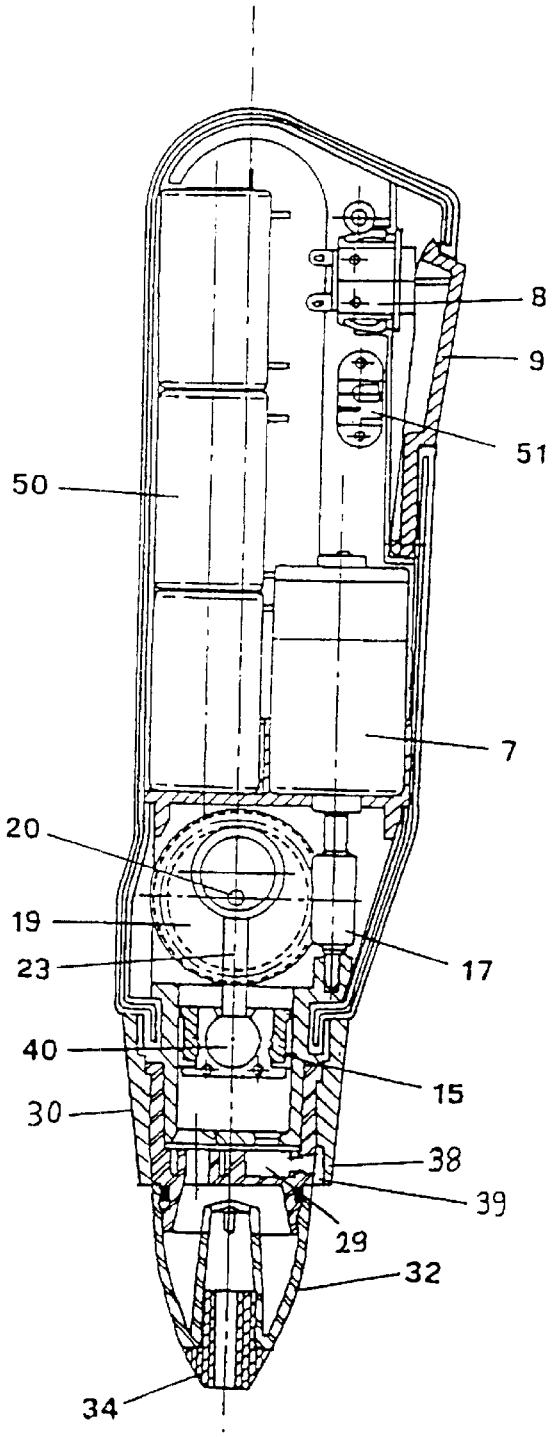
FIG. 6 is a mid-section of a different embodiment of the suction pump according to the invention.

In FIGS. 5 and 6 a different possible embodiment of the invention is shown wherein, in place of the pinion 17, a worm, indicated with reference number 17, is located offset with respect to the rod 23, which actuates a crown gear 19 having a suitable profile.

According to this embodiment feeder batteries 50 are provided, overlapped on a side of the suction pump. With batteries 51, a socket for the battery recharge or, in case, for the feeding by the line current is provided.

Without any substantial change other than simply inverting the functioning of the diaphragm valve 25 the pump can be actuated as a compressor, making it possible to utilize the device according to the invention to blow air into a container, rather than to suck it out.

What is claimed is:

1. A hand-held suction pump for creating a vacuum in a container (2) provided with a suction valve (3), said pump comprising:

an elongated outer casing in which an electric motor (7) and a piston pump (14, 15) driven by the motor (7) are accommodated;

wherein the pump chamber (14) of the piston pump is connected by an inlet valve and a suction duct (28) to a hollow tip (34) at the free end of the casing for direct coupling with the suction valve of the container;

the pump chamber being further connected by an outlet valve to an exhaust duct (29) having a duct opening on the outer surface of the wall of the outer casing for porting an exhaust flow to the exterior of the outer casing;

characterized in that the duct opening of the exhaust duct (29) is overlapped by a baffle (38) which is separated from the outer surface of the wall of the outer casing so as to deflect the exhaust flow exiting the duct opening by a substantial angle.

2. A hand-held suction pump according to claim 1, characterized in that said angle is an angle of substantially 90°.

3. A hand-held suction pump according to claim 1, characterized in that an exit port is formed between the baffle (38) and the wall of the outer casing is positioned relative to the exhaust duct so as to direct the exhaust flow in a direction substantially parallel to the axis of the outer casing toward the hollow tip (34) at the free end of the casing.

4. A hand-held suction pump according to claim 1, characterized in that the baffle (38) is formed by a wall portion of a sleeve (30) attached to the outer casing.

5. A hand-held suction pump according to claim 4, characterized in that the hollow tip (34) is disposed at a terminal cap (32) of the outer casing removably mounted by means of the sleeve (30).

6. A hand-held suction pump according to claim 2, characterized in that an exit port is formed between the baffle (38) and the wall of the outer casing is positioned relative to the exhaust duct so as to direct the exhaust flow in a direction substantially parallel to the axis of the outer casing toward the hollow tip (34) at the free end of the casing.

7. A hand-held suction pump according to claim 2, characterized in that the baffle (38) is formed by a wall portion of a sleeve (30) attached to the outer casing.

8. A hand-held suction pump according to claim 3, characterized in that the baffle (38) is formed by a wall portion of a sleeve (30) attached to the outer casing.

9. A hand-held suction pump according to claim 4, characterized in that the baffle (38) is formed by a wall portion of a sleeve (30) attached to the outer casing.

10. A hand-held suction pump according to claim 7, characterized in that the hollow tip (34) is disposed at a terminal cap (32) of the outer casing removably mounted by means of the sleeve (30).

11. A hand-held suction pump according to claim 8, characterized in that the hollow tip (34) is disposed at a terminal cap (32) of the outer casing removably mounted by means of the sleeve (30).

12. A hand-held suction pump according to claim 9, characterized in that the hollow tip (34) is disposed at a terminal cap (32) of the outer casing removably mounted by means of the sleeve (30).

* * * * *